US005188549A

United States Patent [19]

Kozubski

[11] Patent Number: 5,188,549

[45] Date of Patent: Feb. 23, 1993

[54] AUXILIARY TRIM SYSTEM FOR FISHING BOATS

[75] Inventor: Guy R. Kozubski, McGehee, Ark.

[73] Assignee: Kozubski & Denton, McGehee, Ak.

[21] Appl. No.: 867,346

[22] Filed: Apr. 13, 1992

[51] Int. Cl.[5] ..... B63H 5/12

[52] U.S. Cl. ..... 440/63

[58] Field of Search ..... 440/53, 54, 55, 61-63, 440/900, 56, 65

[56] References Cited

U.S. PATENT DOCUMENTS

| | | | |
|---|---|---|---|
| 3,062,175 | 11/1962 | Mitchell | 440/63 |
| 3,426,723 | 2/1969 | Specht | 440/63 |
| 3,648,645 | 3/1972 | Ezell | 440/63 |
| 3,752,111 | 8/1973 | Meynier, Jr. | 440/63 |

*Primary Examiner*—Edwin L. Swinehart

*Attorney, Agent, or Firm*—Stephen D. Carver; Jerry L. Mahurin

[57] ABSTRACT

An auxiliary trim mechanism adapted to be disposed upon the transom of a boat for trimming an adjacent outboard motor. The mechanism comprises a rigid, flat base for attachment to the boat transom, a lever for actuating the mechanism, a foot for contacting and tilting the motor, and adjustable linkage dynamically linking the handle and the foot. The lever comprises an elongated handle adapted to be manipulated by a user for activating the mechanism, a switch manipulated ratchet for yieldably locking the mechanism in various deflected or undeflected positions and an extension deflected by the handle. The foot comprises an arm, a generally rectangular surface comprising a plurality of separate, spaced-apart, user selectable orifices and a pin adapted to be user-secured to one of the orifices for contacting and deflecting the motor. The pin can be selectively mounted upon predefined orifices within the foot such that motor deflection may be varied without changing the resultant mechanical advantage, or the mechanical advantage established by the mechanism may be changed without varying the distance between the pin and the motor.

11 Claims, 3 Drawing Sheets

AUXILIARY TRIM SYSTEM FOR FISHING BOATS

BACKGROUND OF THE INVENTION

This invention broadly relates to motor tilting mechanisms for power boats. More particularly, the present invention relates to manually operated auxiliary trim systems for conventional outboard motors.

As will be recognized by those skilled in the art, outboard motor trim must often be adjusted A primary reason is to adapt the boat for different loads. Another reason is to facilitate navigation through shallow areas where contact with the bottom or with underwater obstacles must be avoided.

Brackets to adjust the trim of outboard motors have long been present in the art. Some have taken the form of brackets attached to the motors themselves; others are brackets to be attached to the transom of the boat. Some are affixed to both. Macgregor, U.S. Pat. No. 4,682,959, discloses a mounting bracket for an outboard motor that basically consist of two parallel brackets hanging down either side of the motor and a pin or a saddle extending between the brackets to fix the motor at a given trim.

Hervat, U.S. Pat. No. 4,863,405, discloses an outboard motor tilt locking device employed to lock an outboard motor at its fully lifted position. Forsgren, U.S. Pat. No. 4,876,740, discloses an outboard motor tilt mechanism which is intended to lock a motor tilted by hand at a desired position. U.S. Pat. No. 4,826,459 granted to Slatery May 2, 1989 relates a tilt mechanism for outboard motors which is intended to function as the mounting bracket for the motor and does not tilt the motor other than by manually grasping the motor and tilting it. Boda, U.S. Pat. No. 4,925,410, discloses a tilt mechanism lock for outboard motors. This is a lock that can be employed in the conventional brackets of the motor that will positively lock the motor in its most upright position for trailering.

Many patents disclose systems for power tilting a motor. Among these are Pierce, U.S. Pat. No. 4,687,448, Notch, U.S. Pat. No. 4,778,415, and Nakamuran Suzuki, U.S. Pat. No. 4,308,018. Although each of the latter patents relate a system or elements of a system to provide power tilt in an outboard motor, these systems are generally mounted to the transom and/or to the motor. Problems with these systems include reliability, expense, and speed, as well as fixing the motor in a position where it can be damaged when an under water obstruction is struck.

It is desirous to produce a mechanical device which allows one to tilt an outboard motor to a plurality of positions while in operation. It is not necessary that this device be made a part of the motor bracket nor is it necessary for it to be attached to the motor in any way. It can be extremely advantageous to permit the operator to immediately actuate the tilt device without waiting for a hydraulic or electronic system. Such a device must allow for tilt adjustments without restraining the motor to allow the motor to kick back when it contacts an object.

Also, a system allowing immediate release of the motor once an obstacle is cleared would be helpful. Finally, in order to "custom tailor" such a device to the individual user it must allow one to adjust the position of the motor contacting element to change the degree of tilt and motor offset without effecting the mechanical advantage available to the operator at the end of the lever. Meanwhile, the device should allow mechanical advantage to be sacrificed for an even greater amount of tilt. If possible, an ideal device should adjustable to fit a variety of motors of different configurations and dimensions, while allowing variations in the selected mechanical advantage.

SUMMARY OF THE INVENTION

My auxiliary trim system is fastened to the transom of a boat adjacent the conventional outboard motor to readily facilitate quick adjustments in trim. The primary components of the auxiliary trim mechanism are a rigid base adapted to be secured to the transom, an operating lever pivoted to the base, an adjustable foot for contacting the motor's lower unit, and a linkage system interconnecting the foot and the operating lever.

In operation the foot contacts the outboard motor along its output shaft housing but is not connected to the motor thereby allowing the motor to "kick-up" when necessary. To engage the mechanism and tilt the motor one needs only pull down on the operating lever. To release the motor one needs only press a switch on the end of the lever. The tubular handle is then lowered by the operator until the motor is at the desired angle of tilt. When the switch is released the motor is locked at the desired degree of tilt.

The present invention provides a fully customizable configuration. The user may adjust the proximity of the output shaft housing of the motor relative to the mechanism and simultaneously vary the mechanical advantage the operator has available. Each of these adjustments may be made independently of one another.

The rigid base mounts the moving, operative components of the mechanism though a flange system that pivotally links the handle and the foot to the device. The elongated lever comprises of a tubular handle that extends into the boat. A switch formed in the handle releases or sets the foot in a desired position. A spring loaded dog driven by the switch engages a ratchet formed in a flange for locking. The lever is secured between two of the base flanges. Power for the lever is applied by the operator within the boat and the load is linked to the lever at the end of the bracket by a linkage which in turn is connected to the foot. The linkage is adjustable to establish different mechanical advantages, and the degree of lift available at the power end of the operating lever is also variable.

The foot is primarily comprised an axle housing, a major leg, a rectangular mounting surface and a contacting pin. The axle housing secures the foot to the mechanism. An axle passes through the axle housing and two of the base flanges. The major leg extends outward from the axle housing. The major leg is generally disposed in a position parallel to the tubular handle of the lever. The leg terminates in the generally vertical rectangular mounting surface. This surface has a plurality of orifices drilled into it, one of which the contacting pin is secured through. The contacting pin contacts the outboard motor in a position approximately midway down the output shaft housing of the outboard motor. The contacting pin is primarily comprised of a round bar which is connected to the rectangular mounting surface and a roller which moves freely about this bar.

As mentioned above the linkage arm has a plurality of orifices drilled into it. As is evident from the structure of the mechanism, changing the orifice through which the lower pivot pin of the linkage passes will adjust the mechanical advantage and the degree of tilt available to the operator. Furthermore, the plurality of the orifices disposed about the rectangular mounting surface will allow the contacting pin to be positioned according to the dictates of the output shaft housing configuration of the outboard motor. Additionally the orifices in the rectangular mounting surface allow adjustment of the mechanical advantage, the degree of lift available to the operator and the offset of the contacting pin relative to the output shaft housing of the motor.

Therefore, a primary object of the present invention is to provide an extremely light and quick acting mechanically operated manual tilt mechanism for adjusting the trim and tilt of outboard motors.

More particularly, it is an object of the present invention to provide a fast acting, independently actuated tilting mechanism for controlling the tilt and trim in outboard motors without being interconnected electrically or hydraulically.

Another object of the present invention is to provide a trim system of the character described which provides a mechanical advantage to the operator for easily controlling motor trim.

A related object of the present invention is to provide a manual trim adjusting device of the character described whose operative parts can be adjusted to vary the mechanical advantage provided according to the needs of the user.

Another fundamental object of the present invention is to provide a completely manual, auxiliary tilt control apparatus of the character described which readily facilitates boating between shallow and deep regions. It is a feature of the present invention that the motor can be tilted upwardly immediately upon entering shallow water, and when exiting to deeper water the mere pushing of a button can release the motor to drop gravitationally immediately.

Another object of the invention is to provide a manual tilt adjusting device to be used in conjunction with a wide variety of conventional outboard motors, that enables the boat to traverse shallow waters safely and reliably.

A related object is to provide a manual trim adjustment system of the character described, the use of which minimizes motor damage, shock and impact of the boat motor with underwater obstacles.

Another related object of the present invention is to provide a motor tilt adjusting device for river fishing where there are many shallow areas.

A still further object is to provide a tilt adjusting system of the character described that is extremely fast, but not hindered by slow action of conventional electric motors or hydraulic cylinders.

A still further object of the present invention to provide a tilt adjusting system which responds immediately when released.

Another object of the present invention is to provide a mechanism of the type disclosed which can be adjusted by the user to provide the necessary mechanical advantage while preserving the device's offset from the motor.

Conversely an object of the present invention is to provide a device of the nature disclosed that preserves an established mechanical advantage while allowing a user to adjust the offset of the mechanism relative to the motor.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
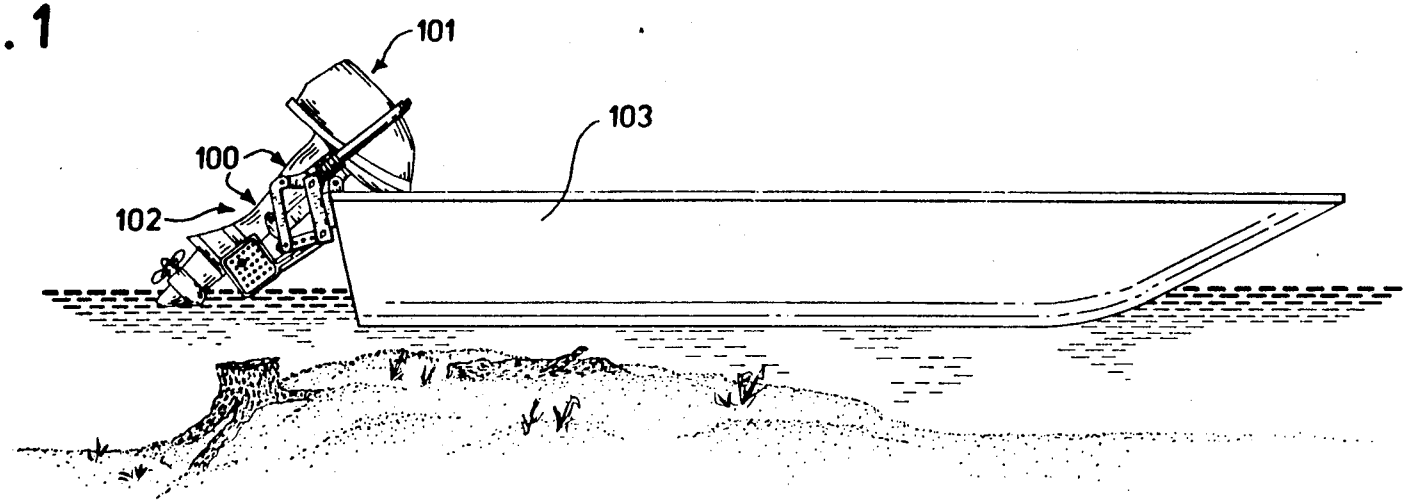
FIG. 1 is a fragmentary pictorial view showing the system installed upon a conventional boat.
Figure 3:
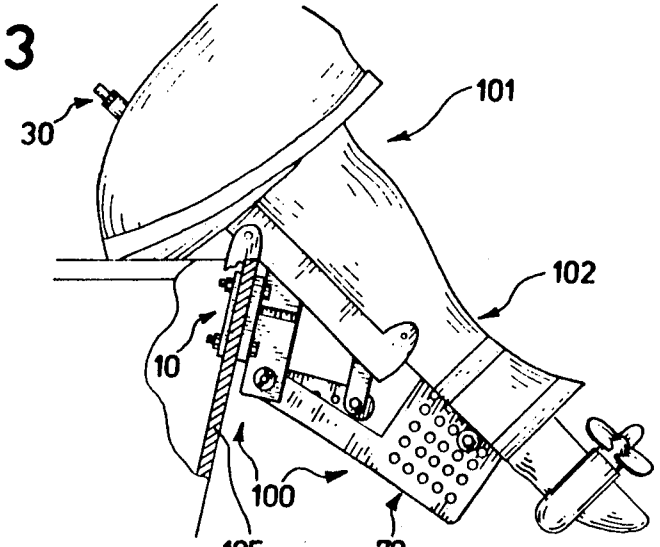
FIG. 3, is an enlarged, fragmentary elevational view showing the side opposite that of FIG. 2.
Figure 2:
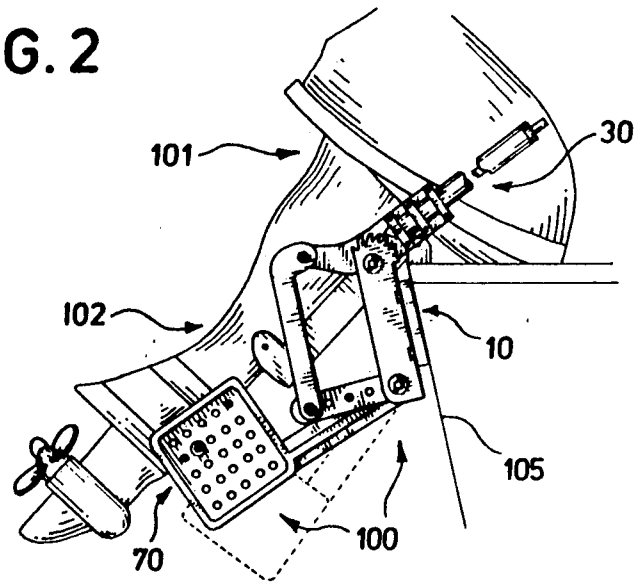
FIG. 2 is an enlarged, fragmentary side elevational view, with movement of the device indicated in dashed lines.
Figure 4:
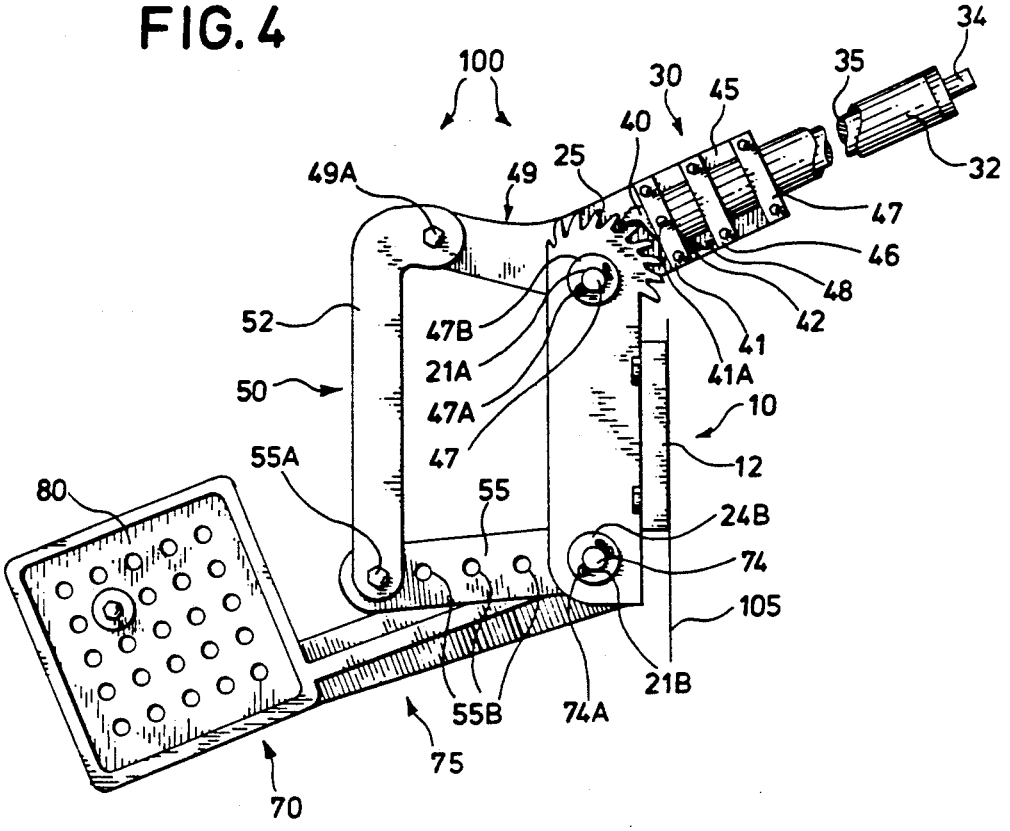
FIG. 4 is an enlarged, fragmentary side elevational view, with portions thereof broken away for clarity.

Turning now to the drawings, the best mode of my auxiliary trim mechanism for outboard boat motors is broadly designated by the general reference numeral 100. Mechanism 100 is secured to the transom of a conventional fishing boat for tilting the adjacent outboard motor. The primary components of the tilting mechanism 100 are a rigid base 10, an operating lever 30 that extends into the boat, 103 a foot 70 that contacts and deflects the outboard motor, and a linkage system that interconnects the foot with the lever 30. A variable mechanical advantage can be achieved.

The present invention provides a custom configuration. The user may adjust the proximity of the output shaft housing 102 of the motor 101 relative to the foot 70 and simultaneously vary the mechanical advantage the operator has available. Each of these adjustments may be made independently.

Figure 7:
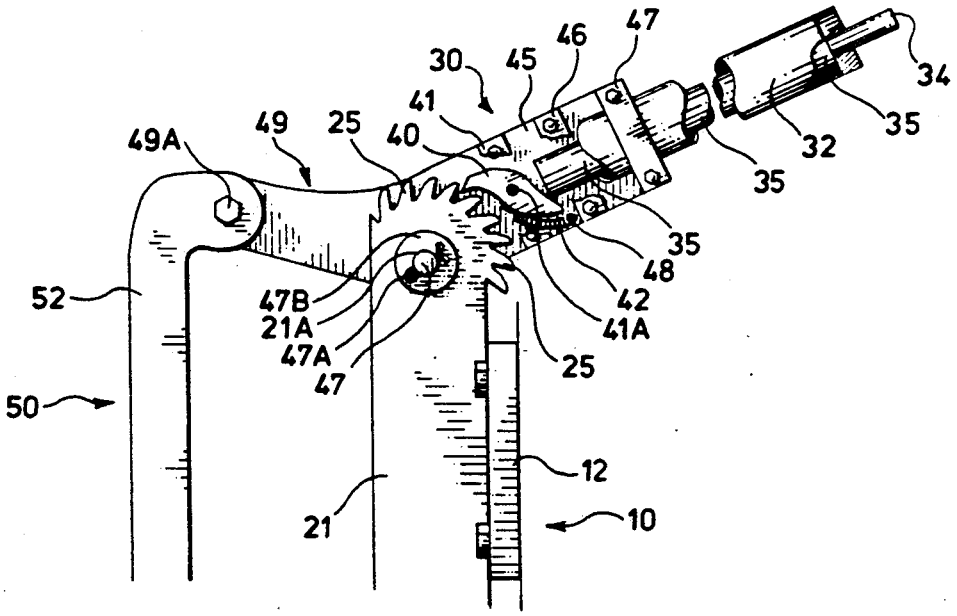
FIG. 7 is an enlarged fragmentary side elevational view showing the locking system, with portions thereof broken away for clarity or omitted for brevity.

With reference to FIGS. 4–7, the principal function of the rigid base 10 is to mount the moving, operative components of the mechanism 100 to a boat transom 105. The rigid base 10 is primarily comprised of a flat, generally rectangular main plate 12 mounted flush to the boat transom 105 to secure the mechanism 100, and a flange system 20 (FIG. 6) that projects outwardly from plate 12. The flange system preferably comprises first, second, and third flanges 21–23 welded to or integral with plate 12. Flanges 21–23 are disposed generally perpendicular relative to transom 105 and plate 12, the waterline 14 (FIG. 1). The first flange 21 is longer than the other two and is constructed, as are the other flanges, from a flat piece of steel plate. Longer flange 21 has two orifices 21A and 21B passing through it. The orifices 21A and 21B have central axes generally parallel to t he plate 12. The first flange 21 also has a set of ratchet teeth 25 machined into its uppermost edge (FIG. 7). The second flange 22 is parallel with and slightly spaced apart from flange 21 and has a single orifice 22A registered with upper orifice 21A in the first flange 21. The third flange 23 is relatively distant from the first two flanges 21 and 22 and has a single orifice 23B in it. It is parallel with the other flanges. Orifice 23B registers with lower orifice 21B in the first flange 21.

As best illustrated by FIG. 7, the elongated operating lever 30 comprises an elongated, tubular handle 32 that extends rearwardly into the boat for manual activation. The opposite end of the handle is secured to a leverage bracket 45. A plunger-like switch 34 is mounted in the handle end. A coaxial follower 35 extends within the handle from switch 34 to contact a spring-loaded dog 40 pivoted to bracket 45 at 41A. The bracket 45 is secured between the first and second flanges 21 and 22 by a secondary axle 47 passing through the upper orifice of the first flange 21 and the orifice in the second flange 22. This axle 47 is secured by cotter pins 47A and washers 47B on each end. A spring 42 secured upon bracket 45 normally urges dog 40 into engagement with the ratchet 25.

The tubular handle 32 is generally a piece of round tubing. The switch 34 is disposed in the end of the tubing most remote relative to the mechanism 100 therefore, closest to the operator of the boat 103. This switch 34 depresses follower 35 to deflect dog 40 out of engagement with the ratchet 25. The spring loaded dog 40 is mounted by a collar 41 to the bracket 45 in close proximity to the ratchet teeth 25 machined into the upper edge of the first flange 21 of the rigid base 10. The collar 41 that mounts the ratchet dog 40 to the bracket 45 provides a pivot point 41A at its center for the spring loaded dog 40. Further, the bracket 45 mounts the tubular handle 32 by two larger collars 46 and 47. Additionally, the bracket 45 contains an anchoring pin 48 for a spring 42 that is attached to the dog 40 to bias the dog 40 into contact with the ratchet teeth 25 of the first flange 21.

The bracket 45 together with the tubular handle 32 comprise a lever 30 with its fulcrum at the secondary axle 47. Power for this lever 30 is applied by the operator within the boat 103 and the load is linked to lever 30 at the end of the bracket's extension 49 by an upper pivot pin 49A. Linkage 50 is connected to this upper pivot pin 49A interconnecting the lever 30 assembly with a foot 70. This linkage 50 is comprised of two relatively flat parallel members 51 and 52 formed from plate or bar stock. These members 51 and 52 are mounted one on either side of the extension 49 of the bracket 45 by an upper pivot pin 49A passing through it. In the preferred embodiment, this upper pivot pin 49A is a conventional bolt with a nut securing it.

Linkage 50 is further comprised of an arm 55 joined to the parallel members by a lower pivot pin 55A, also preferably a conventional bolt and associated nut. This arm 55 is affixed to the foot 70 and has a plurality of orifices 55B disposed in it to facilitate adjustment of the mechanical advantage and the degree of lift available at the power end of the operating lever 30. The foot 70 to which the lever 30 is interconnected by the linkage 50 is primarily comprised of an axle housing 72, a major leg 75, a rectangular mounting surface 80 and a contacting pin 90.

The axle housing 72 secures the foot 70 to the mechanism 100. A major axle 74 passes through the axle housing 72 and the lower pivot orifice 21B of the first flange 21 on one side and the pivot orifice 23B of the third flange 23 on the other. The major axle 74 is secured by cotter pins 74A passing through the ends of the axle that protrude beyond the flanges and washers 74B.

The major leg 75 extends outward from the axle housing 72. When the mechanism 100 is in the fully extended tilt position, the major leg 75 is generally perpendicular to the transom 105 of the boat 103. However, when the tilt mechanism 100 is disengaged the major leg 75 is disposed in a generally vertical position therefore, parallel to the transom 105 of the boat 103. Hence, the major leg 75 is generally disposed in a position parallel to the tubular handle 32 of the lever.

The major leg 75 extends from the axle housing 72 initially perpendicular to the axle 74 in two dimensions. Once it clears the third flange 23 it is angularly disposed away from the other operative components of the mechanism 100. This leg 75 terminates in the rectangular mounting surface 80. The rectangular mounting surface 80 is a piece of plate with a plurality of orifices 80A drilled into it. The rectangular mounting surface 80 is disposed on the leg 75 in a generally vertical orientation, parallel to the flanges 21, 22, and 23 and therefore perpendicular to the transom 105 of the boat 103.

Displacements are created when extension 49 deflects linkage 50, arm 55 and thus foot 70. Contacting pin 90 attached to a selected orifice in mounting surface 80 within one of its orifices 80A contacts the outboard motor 101 clear of the other components of the mechanism 100. This contacting pin 90 contacts the outboard motor 101 in a position approximately midway down the output shaft housing 102 of the outboard motor 101. The contacting pin 90 is primarily comprised of a round bar 91 that is connected to the rectangular mounting surface 80 and a roller 92 that moves freely about this bar 91.

As mentioned above the linkage arm 55 has a plurality of orifices 55B drilled into it. As is evident from the structure of the mechanism 100, changing the orifice 55B through which the lower pivot pin 55A of the linkage 50 passes will adjust the mechanical advantage and the degree of tilt available to the operator. Furthermore, the plurality of the orifices 80A disposed about the rectangular mounting surface 80 will allow the contacting pin 90 to be positioned according to the dictates of the output shaft housing configuration of the outboard motor 101, Additionally the orifices 80A in the rectangular mounting surface 80 provide a way to adjust the mechanical advantage, the degree of lift available to the operator and the offset of the contacting pin 90 relative to the output shaft housing 102 of the motor 101.

Therefore, the plurality of orifices 80A in the rectangular mounting surface 80 in conjunction with the plurality of orifices 55B along the arm 55 of the linkage 50 allows one to customize the mechanism 100 for a particular application thereby, providing a desirable degree of lift coupled with a convenient mechanical advantage. In other words, one can position the contacting pin 90 close to the body of the boat 103 and low on the rectangular mounting surface 80 and position the pivot pin 55A of the linkage 50 to the outer extreme of linkage arm 55 to provide a great amount of tilt at the greatest mechanical advantage. One may position the contacting pin in the highest position closest to the boat 103 and position the linkage 50 in the orifice of the linkage arm 55 closest to the boat 103, thereby reducing the mechanical advantage but giving an even greater degree of tilt for each notch of the ratchet teeth 25 in the top of the first flange 21 that is engaged by the dog 40.

Figure 5:
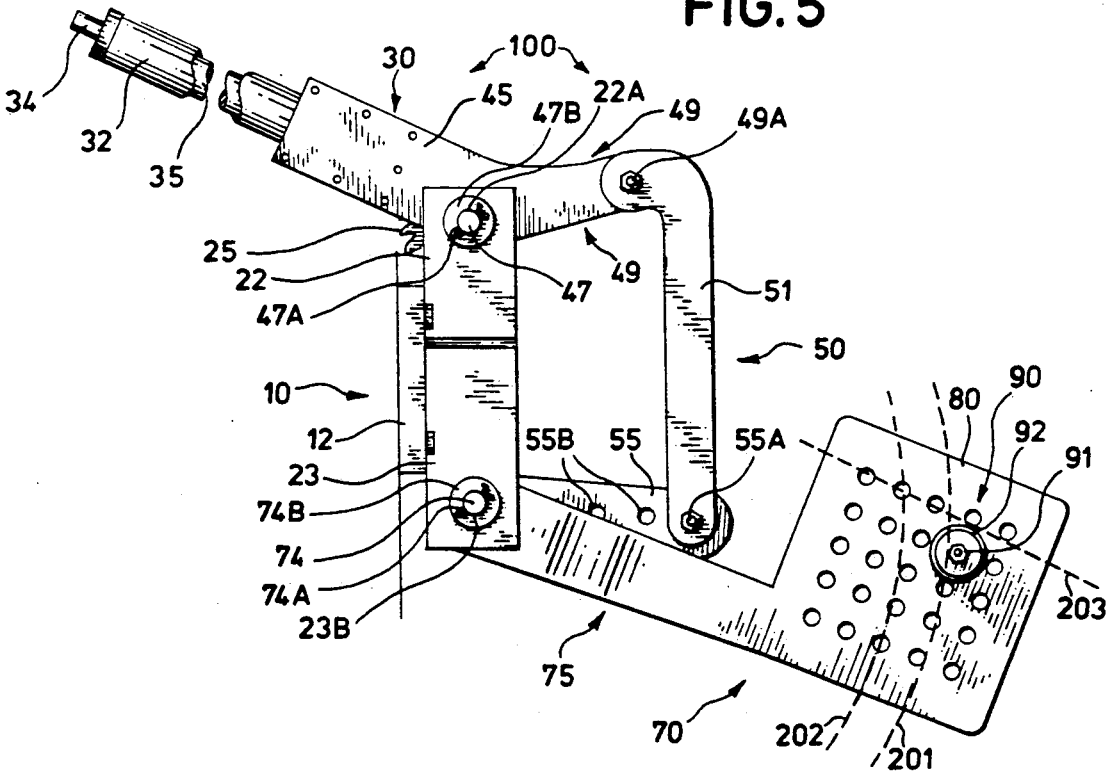
FIG. 5 is an enlarged, fragmentary side elevational view showing the side opposite that of FIG. 4.
Figure 6:
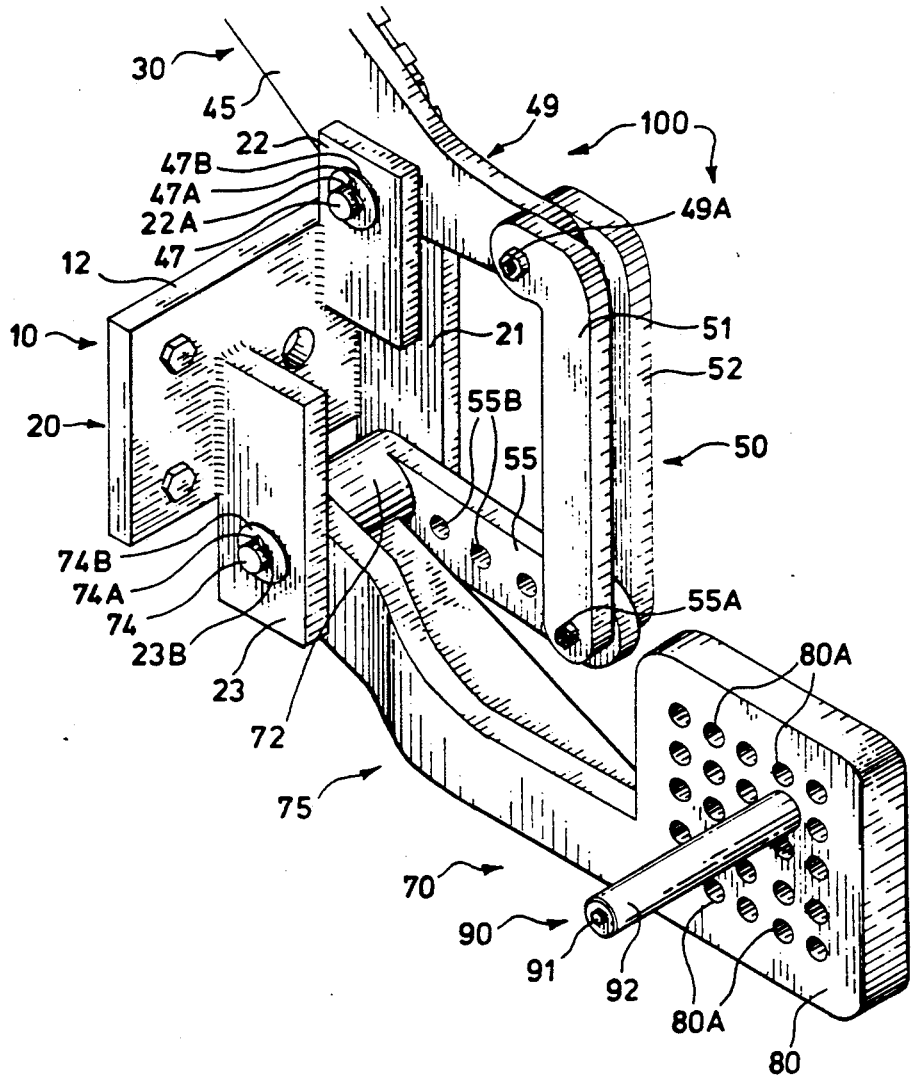
FIG. 6 is an enlarged, interior isometric view.

More specifically, the plurality of orifices 80A in the rectangular mounting surface 80 define a plurality of arcs 201 and 202, as illustrated in FIG. 5. These arcs define orifice locations where the moment arm is constant. Whereby for a particular mechanical advantage set at the arm 55 of the linkage 50, the position of the contacting pin 90 may be altered to provide a varying degree of lift while maintaining a desired offset between the motor 101 and the contacting pin 90.

Thus as long as pin 90 projects from one of the orifices 80A intersected by arcs 201 or 202, for example, the desired mechanical advantage will be preserved, but the contacting pin may be adjusted toward or away from the motor. On the other hand, where the distance between the contacting pin 90 and the motor must be preserved, adjustments to the overall mechanical advantage can be made by moving contact pin 90 within orifices intersected generally by line 203 (FIG. 5).

In operation the contacting pin 90 contacts the outboard motor 101 along its output shaft housing 102 but is not connected to the motor 101 itself, thereby allowing the motor 101 to "kick-up" when necessary. To engage the mechanism 100 and tilt the motor 101 one needs only pull down on the tubular handle 32. Thereby rotating the foot 70 and lifting the motor 101. When the tubular handle 32 is pulled down the spring loaded dog 40 engages the ratchet teeth 25 and locks the mechanism 100 in the tilted position. To release the motor 101 one need only press the switch 34 at the remote end of the tubular handle 32 to disengage the dog 40 from the ratchet teeth 25. While grasping the handle, with the dog released, the motor can be lowered. When an underwater obstacle is encountered, the motor may deflect freely out of contact with the foot.

Tubular handle 32 can be lowered by the operator until the motor 101 is at the desired angle of tilt. When the switch 34 is released the dog 40 will re-engage the ratchet teeth.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An auxiliary trim mechanism adapted to be disposed upon the transom of a boat for trimming an adjacent outboard motor, said mechanism comprising:

rigid base means for mounting said mechanism to said boat, said base means comprising a rigid plate adapted to be secured to said transom;

lever means for activating said mechanism, said lever means pivotally associated with said base means and comprising an elongated handle adapted to be manipulated by a user for activating said mechanism and an extension deflected by said handle;

foot means for tilting said outboard motor, said foot means pivotally associated with said base means, said foot means comprising a generally rectangular surface comprising a plurality of separate, spaced-apart, user selectable orifices and pin means adapted to be user-secured to a selected one of said orifices for contacting and deflecting the motor;

linkage means for coupling said foot means to said lever means, said linkage means adapted to be user adjusted to vary the resultant mechanical advantage;

wherein said pin means can be selectively mounted upon selected orifices within said foot means such that motor deflection may be varied without changing said resultant mechanical advantage, or the mechanical advantage established by said mechanism may be changed without varying the distance between said pin and said motor; and, switch means for yieldably locking said mechanism in a lifted position to prevent dropping of said motor while permitting further upward deflections in response to underwater obstacles or obstructions.

2. The auxiliary trim mechanism as defined in claim 1 further comprising ratchet means for yieldably locking said mechanism and dog means driven by said switch means for engaging said ratchet means, and wherein said handle comprises an internal follower responsive to said switch means for controlling said dog means.

3. The auxiliary trim mechanism as defined in claim 2 including spring means for yieldably biasing said dog means into engagement with said ratchet means.

4. The auxiliary trim mechanism as defined in claim 3 wherein said ratchet means is associated with said base means.

5. The auxiliary trim mechanism as defined in claim 3 wherein said linkage means is comprised of a pair of spaced apart arms pivotally extending from said lever means and a member pivotally extending from said arms fixed to said foot means.

6. An auxiliary trim mechanism to be disposed upon the transom of a boat for trimming an adjacent outboard motor, said mechanism comprising:

rigid base means for mounting said mechanism to said boat, said base means comprising a rigid plate adapted to be secured to said transom;

lever means for activating said mechanism, said lever means comprising an elongated handle adapted to be manipulated by a user for activating said mechanism and an extension deflected by said handle;

foot means for tilting said outboard motor, said foot means comprising a generally rectangular surface comprising a plurality of separate, spaced-apart, user selectable orifices and pin means adapted to be user-secured to a selected one of said orifices for contacting and deflecting the motor;

linkage means for coupling said foot means to said lever means, said linkage means adapted to be user adjusted to vary the resultant mechanical advantage;

flange means projecting outwardly from said base means for pivotally mounting said lever means and said foot means; and, wherein said pin means can be selectively mounted upon selected orifices within said foot means such that motor deflection may be varied without changing said resultant mechanical advantage, or the mechanical advantage established by said mechanism may be changed without varying the distance between said pint and said motor.

7. The auxiliary trim mechanism as defined in claim 6 including switch means for yieldably locking said mechanism in a lifted position to prevent dropping of said motor while permitting further upward deflections in response to underwater obstacles or obstructions.

8. The auxiliary trim mechanism as defined in claim 7 further comprising ratchet means associated with said flange means for yieldably locking said mechanism, and dog means driven by said switch means for engaging said ratchet means.

9. The auxiliary trim mechanism as defined in claim 8 wherein said handle comprises an internal follower responsive to said switch means for controlling said dog means, and said dog means is pivotally captivated upon said lever means.

10. The auxiliary trim mechanism as defined in claim 9 including spring means for yieldably biasing said dog means into engagement with said ratchet means.

11. The auxiliary trim mechanism as defined in claim 10 wherein said linkage means is comprised of a pair of spaced apart arms pivotally extending from said lever means and a member pivotally extending from said arms fixed to said foot means.

* * * * *